US005290344A

United States Patent [19]

Onodera

[11] Patent Number: 5,290,344

[45] Date of Patent: Mar. 1, 1994

[54] WASTE FILTER REFRESHING APPARATUS FOR DRY CLEANING MACHINE

[75] Inventor: Masaji Onodera, Thuruoka, Japan

[73] Assignee: Onodera Doraikuriiningu Kojo Co., Ltd., Yamagata, Japan

[21] Appl. No.: 30,023

[22] PCT Filed: Sep. 19, 1991

[86] PCT No.: PCT/JP91/01241

§ 371 Date: May 25, 1993

§ 102(e) Date: May 25, 1993

[87] PCT Pub. No.: WO92/05307

PCT Pub. Date: Feb. 4, 1992

[30] Foreign Application Priority Data

Sep. 25, 1990 [JP] Japan ..... 2-256458

[51] Int. Cl.[5] ..... B01D 53/04

[52] U.S. Cl. ..... 96/127; 96/131; 96/134; 55/269; 55/484; 55/485

[58] Field of Search ..... 55/264, 484, 485; 96/126, 131, 133, 127, 134

[56] References Cited

U.S. PATENT DOCUMENTS 3,309,844 3/1967 Hemstreet et al. ..... 55/269 X
4,559,138 12/1985 Hayms ..... 55/484 X
4,759,845 7/1988 Selesnick ..... 55/485 X

*Primary Examiner*—Charles Hart
*Attorney, Agent, or Firm*—Armstrong, Westerman, Hattori, McLeland & Naughton

[57] ABSTRACT

A clarifying apparatus for waste and dirty filters of a cartridge type is used in the dry cleaning machine. The filters become dirty after they are used for a long time necessitating replacement. The clarifying apparatus is used to treat the dirty filters. The apparatus is used after a plurality of waste filters are connected in series and they are placed in a pressure tank 5 and sealed. The apparatus has a reheating means 6 installed around the outer circumferential face of the pressure tank, a circulation duct 53 connecting a side 51 of hot air taking-in and another side 52 of an outlet for hot air containing solvent has a cooling means 54 recovering solvent and a heating means 55 placed downstream of the cooling means. Hot air is supplied from a hot air taking-in port 51 of the pressure tank 5 to through the serially-connected core pipes 11 and around respective waste filters 1 in order to evaporate remaining solvent and recover it, and clarify the dirty filters.

1 Claim, 2 Drawing Sheets

WASTE FILTER REFRESHING APPARATUS FOR DRY CLEANING MACHINE

TECHNICAL FIELD OF THE INVENTION

The present invention relates to a filter used refreshing or cleaning apparatus for a dry cleaning machine.

DESCRIPTION OF THE PRIOR ART

Resulting of development of various materials for improving cleaning effect in the cleaning machines, the presently-used machines mainly employ, in place of organic petroleum solvents having a relatively high ignition point, inflammable synthetic solvents such as perchloro ethylene and the like and bulklene (phonetic) of fluorine solvent.

When such dry cleaning processes using these solvents above are employed, these solvents are expensive comparing to water used in water washing process, so dirty solvent after once used in the dry cleaning process has been used several times after being treated as shown below. The dirty solvent used passes once at a time through a filter device installed in the dry cleaning machine in order to remove insoluble dust and rubbish and then filtered and cleaned solvent returns to the machine.

When the level of soluble dirt collected or deposited in the solvent rises over a certain limit, the dirty solvent is boiled and oil and fat contained therein is removed through an centrifugal machine.

The maximum number of repeating or clarifying solvent to be used in the washing machine or dry cleaning machine having such filter device and centrifugal machine above is ordinarily 700 to 800 times when a volume or weight to be cleaned in a washing machine at a time is about 30 kg. If goods of more heavy is dry cleaned in the machine, the filter for removing insoluble dust and rubbish clogs up and the goods to be clarified fails to be cleaned or cleaning effect of the dry cleaning machine considerably decreases. Then, the clogged filter must be changed.

According to the filter of one kind, it is constructed by a core pipe, an absorbent material such as activated carbon installed in a circumferential space of the core pipe, and a water pervious sheet such as washi (Japanese paper) and non-woven cloth covering an outer peripheral surface of the absorbent material. Ordinarily, the cylindrical conventional filter above is of a cartridge type and enables to enter in and remove from the dry cleaning machine.

So called waste or useless filter clogged and necessitated to be changed with new one contains insoluble dust and rubbish of more than permittable level, which are removed from the goods cleaned by the dry cleaning machine, as well as solvent is soaked and remained in the waste filter.

Comparing to a new filter of a type used for goods of 30 kg per one usage having a weight of 15 kg, a waste filter used has a so high weight as about 45 kg. It is apparent that the weight of insoluble dust and rubbish and solvent contained in the waste filter is about 30 kg.

Examining the contents of the remainings of 30 kg in the case above, it has been found that about 5 kg is insoluble dust and rubbish and the rest of about 25 kg is solvent. It is not economical to discard much solvent contained in the waste filter, and more importantly it is prohibited to discard or dispose selfishly perchloro ethylene and bulklene of solvent. Perchloro ethylene and bulklene are designated as harmful and hazardous materials and consequently they must be conveyed and destroyed by fire and disposed through specialists or authorized persons.

Unfortunately, there is no specialists or authorized persons treating such special and hazardous materials in particular districts. For example, concerning Yamagata-ken of a district, Japan there is no specialists or authorized persons, and so it is necessary to take the trouble to ask specialists in Niigata-ken or Niigata prefecture neighboring Yamagala prefecture, discarding the hazardous materials. It is not only inconvenient and but also not economical because recovery cost of the materials is ¥180 per kg (in the case above, 45 kg×¥180=¥8100 per a waste filter). Consequently, with reference to the large cleaning shop using many filters, the cost of the filters is made huge, as well as treating or handling them is very troublesome.

In order to solve the problems of the prior art, the present invention provides a waste dirty filter cleaning or refreshing apparatus of a dry cleaning machine having a novel construction enabling to recover hazardous solvent remained in the waste and used filter, as well as to clarify the waste filter itself.

It is the purpose of the present invention to provide a waste filter refreshing apparatus for a dry cleaning machine, which apparatus has been realized by developing an apparatus for recovering substantially all solvent remained in the waste filters and remove ill effects of hazardous materials, and also resultantly reduce as much as possible the weight of the waste filter itself without special operative technique. By realizing the waste filter refreshing apparatus described above, the waste filters can be treated without difficulty, and economical burden to be paid to the recovery specialist can be reduced considerably.

SUMMARY OF THE INVENTION

Basically, the waste filter refreshing apparatus for the dry cleaning machine, comprising several joint packings connecting a plurality of waste filters in series in said apparatus so as to connect respective core pipes of the waste filters straightly from a hot air intaking side to an end of the serial filters, a reheating heater installed around the outer periphery of said pressure tank, a circulation duct connecting the hot air intaking side and an outlet of hot air containing solvent gas, a cooling means for recovering solvent, and a heating means placed in a downstream of the cooling means, wherein hot air is supplied from the hot air intaking port of the pressure tank so serially-connected core pipes and outer peripheries of respective waste filters in order to evaporate remaining solvent in the waste or dirty filters and recover it from the dirty filters clarifying the waste filters.

The joint packings functions after placed between the opposing core pipes of two adjacent filters in order to connect these waster filters to each other in series. And these joint packing also is placed between the interior of the pressure tank at a side of the hot air taking-in side and the core pipe of the waste dirty filter opposing to the interior, and another joint packing is placed between the interior of the sealing lid of the pressure tank and the core pipe of the waste dirty filter opposing to the interior. That is, two joint packings mentioned above are placed at both ends of the set of the dirty filters placed in the pressure tank functioning to prevent hot air from leaking through both the through both the ends of the core pipe of the dirty filter, as well as joining two core pipes. It is necessary to manufacture the joint packing of a material which doesn't corrode easily with any solvent.

It is preferable that respectively known cooling apparatus and known heating apparatus are used for the cooling means and heating means, respectively adapted to be employed in the circulation duct of the waste filter refreshing apparatus of the present invention. It is sufficient when these cooling means and heating means, respectively effectively liquifies solvent gas contained in the hot air sent from the pressure tank, and in the step just after the cooling step heats the air flow cooled after the solvent is separated therefrom to the predetermined temperature. Then, the hot air is again sent to the hot air taking-in port of the pressure tank.

The reheating heater functions supplementarily heating flowing hot air while it flows through the pressure tank, solvent is taken out of the filter, and the filter is washed. It is preferable that the heater has an interior temperature sensor (not shown) built in and functioned automatically.

The higher the pressure in the pressure tank rises, the higher efficiency of the waste filter refreshing apparatus rises. Consequently, it is preferable that a pressure gauge (not shown) is installed at a side of the hot air taking-in side and it is suitably controlled obtaining the best pressure for the apparatus of the present invention.

DETAILED EXPLANATION OF THE PREFERRED EMBODIMENT

In order to most clearly explain the present invention, a preferred embodiment of the waste filter refreshing apparatus will be described with reference to the accompanying drawings.

Figure 1:
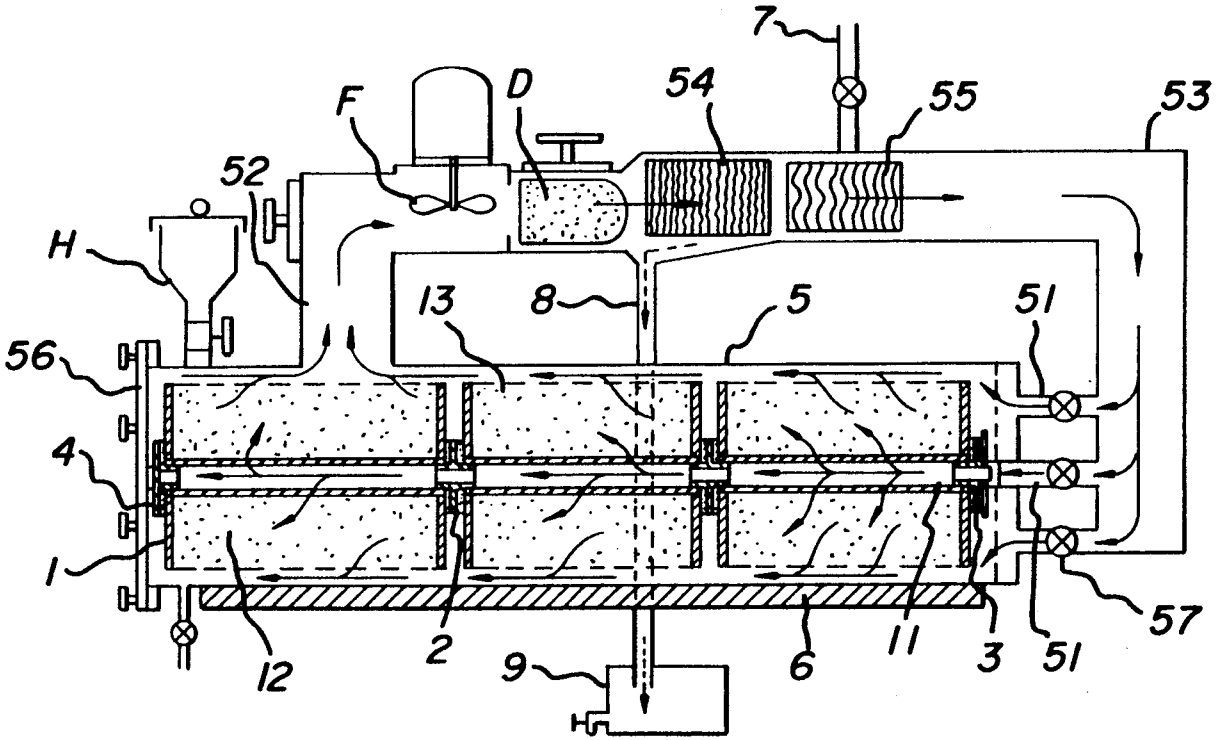
FIG. 1 is a systematic view of the waste filter refreshing apparatus for a dry cleaning machine according to an embodiment of the present invention.

As apparent from FIG. 1 showing a systematic view of the present invention, three waste filters 1 are joined or connected in series through joint packings 2, 3 and 4, and these filters and joint packings are placed in a pressure tank b completely closed by a sealing lid 56.

Figure 2:
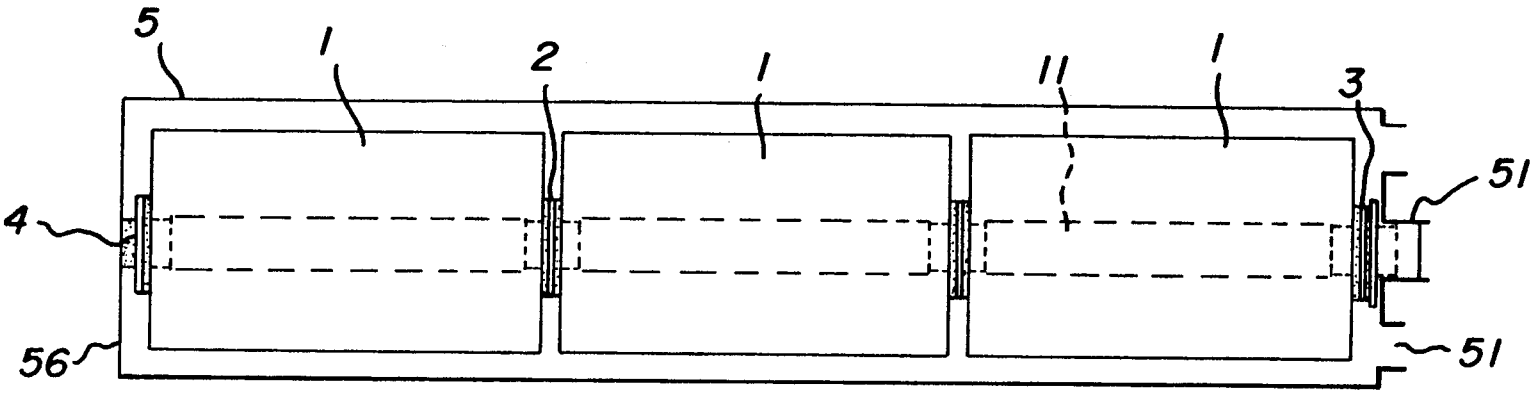
FIG. 2 is a sectional view of an important portion of the waste filter refreshing apparatus.
Figure 3D:
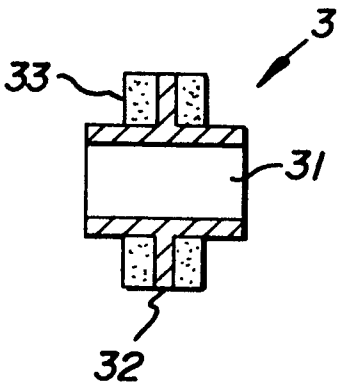
FIG. 3 (A)-(D), respectively show various joint packings used in the waste filter refreshing apparatus of the present invention.
Figure 3C:
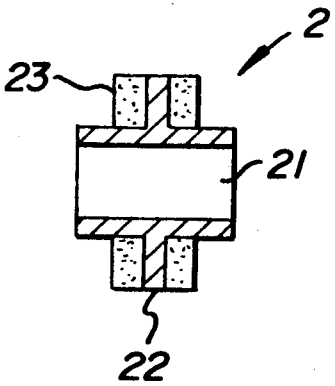
Figure 3B:
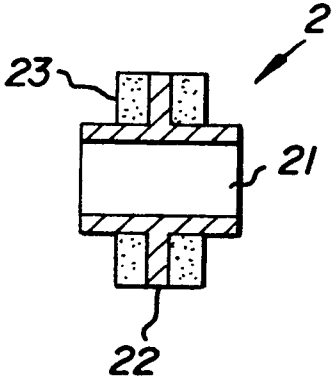
Figure 3A:
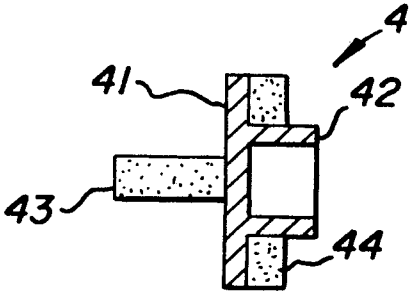

As clear from FIG. 2 depicting an enlarged view of the waste filter refreshing apparatus, joint packings 2 shown in FIG. 3 (B) and (C) in section are employed between the waste filters 1.

The joint packing 2 has a connecting pipe 21 enabling to insert on each end of the core pipe 11, and two resilient plates 23 of silicon rubber and the like. The resilient plates 23 are applied and placed to a flange 22 extruding from a center of the connecting pipe 21 in a perpendicular direction, and the resilient plates 23 are piled on the flange 22 in a manner of integrity.

Another joint packing 3 shown in FIG. 3 (D) is adapted to be placed between an intake opening to the core pipe 11 in a hot air intake opening 51 of the pressure tank 5 and an end of the core pipe 11 of the waste filter 1, which end facing the intake opening of the core pipe 11. The construction of the joint packing 3 is similar to that of the joint packing 2, and has a connecting pipe 21 provided with a flange 32, and a pair of resilient plates 33 piled on both the sides of the flange 32.

Still another joint packing 4 is used between the sealing lid 56 and the waste filter 1 confronting with the lid. Concerning a construction of the joint packing 4, a connecting pipe 42 is extruded from one side of the flange 41 as shown in FIG. 3 (A), a lengthy resilient plate 43 is placed at a center of the opposed side of the flange 41, and a resilient plate 44 is integrally placed around the connecting pipe 42. When the sealing lid 56 is closed so as to make the resilient plate 43 come into contact with a center of the lid 56, these waste filters 1 are contained or placed in series in the pressure tank 5.

After the pressure tank 5 containing the waste filters 1 placed in series therein, three valves 57 are opened leading hot air from a blowing pipe 7, which are being heated by flowing through a heating spot or means 55. The hot air flows through the core pipes 11, respectively connected in a manner of a through hole and along outer circumferential faces of the waste filters connected in series.

By a reheating means or heater 6 appropriately functioning, the temperature of the flowing hot air is kept at its predetermined one and hot air holding at its predetermined temperature flows along the directions shown by arrows. During the flowing, hot air sent into the core pipes 11 connected in series is protected by the joint packings 2, 3 and 4 placed at the connecting portions of the core pipes 11 so as to prevent hot air from leaking through the connecting portions. Thus, hot air is compulsorily and firmly led to the absorbent agent layers 12, respectively placed around the core pipes 11 of the waste filters 1 in order to effectively evaporate and clarify the liquid solvent agent absorbed and impregnated in the absorbent agent layers 12. After such evaporation and clarifying function continues, hot air escapes from an outlet of hot air containing solvent gas to a circulation duct 53 reaching a cooling spot or means 54.

When hot air containing solvent gas is cooled in the cooling means 54, the solvent gas flowing through the hot air outlet 52 and the circular duct 53 is sequentially liquified. Then, solvent liquid flows through the cooling means 54, a recovery pipe 8, and the recovery tank 9 along the dotted line shown. The solvent liquid is stored in the recovery tank 9.

According to the embodiment of the waste filter refreshing apparatus of the present invention, a power fan F is employed to realize a smooth circulation of hot air, and further a dust removing filter D is employed and placed at a position immediately before the cooling means 54 in order to prevent insoluble dust and rubbish separated from the waste filter 1 from scattering and being carried in the circulation duct 53 reaching the cooling means 54.

However, it is noted that such construction and arrangement of the power fan F and the dust removing filter D can change within the space of the claims.

In case that sludge deposited in the dry cleaning machine is necessary to recover solvent therefrom, a sludge charging hopper H is installed in the waste filter refreshing machine. In practice, an operator takes out sludge from the dry cleaning machine and charges the sludge to the waste filter refreshing machine.

The flow of air cooled and without solvent separated passes through the heating means 55 arranged immediately after the cooling means 54, so that the cooled air backs to its original hot air repeating the process above.

When hot air is short in volume or pressure of the air fails to rise lowering an inner pressure of the waste filter refreshing apparatus of the present invention, new hot air is supplied to the circulation duct 53 from an air supply pipe or blowing pipe 7.

When a temperature of the circulating hot air lowers than a suitable level, the reheating heater 6 functions to make the air hot.

Effect of the Invention

As described above, the waste filter refreshing apparatus of the dry cleaning machine according to the present invention contains a plurality of waste filters 1 arranged in series, and respective core pipes of the waste filters 1 are connected by joint packings 2, 3 and 4 so as to make hot air pass through the respective waste filters. Therefore, comparing to the conventional system for refreshing waste dirty filter having a means to pass hot air only around the outer periphery or circumference of the dirty filters, hot air flowing through the waste dirty filter refreshing apparatus of the present invention passes firmly and compulsorily through the interiors of the filters, in particular, into the absorbent layers 12 containing much solvent. Resultant to the facts above, it is possible that substantially all solvent in the dirty filters 1 is evaporated and recovered, as well as the waste dirty filters 1 themselves are clarified and refreshed. Total weight of the clean filter containing insoluble dust equals to a weight of the filter itself plus a weight of the insoluble dust. The total weight of the refreshed filter is right comparing to that of the dirty one, therefore it is very easy and safe to handle them. These refreshed filters can be stored easily before passing to the special recovery factory.

In addition, it is noted that the recovery cost per a clean filter charged by the factory can be reduced to about a third of the conventional system using no waste filter refreshing apparatus.

Concerning the construction of the waste filter refreshing apparatus of the present invention, it mainly has the pressure tank 5 and the circulation duct 53 provided with the cooling means 54 and the heating means 55, therefore it is very simple. Only providing several joint packings 2, 3 and 4 with the waste filter refreshing apparatus in order to joint the waste filters 1 in series, the waste filter refreshing apparatus functions effectively. Additionally, it is easy to handle and maintain the apparatus properly reducing the cost of maintenance and increasing the profits of the dry cleaning shop owners.

Industrial Usability

When the cleaning shop owner uses the waste filter refreshing apparatus for the dry cleaning machine, handling of designated toxic and hazardous solvent which is necessary to run a cleaning shop can be done easily and safely more than when the conventional system is used. Concerning the cost burden to be shouldered by the owner, refreshed filters are continuously recycled to the special or chartered recoverers reducing the cost charged by the recoverers. In particular, in the districts and area without such waste filters recovering factories, dry cleaning shops can open and run with low cost and high expectations and valuation are obtained by the entrepreneur and shop owners.

What is claimed is:

1. A waste filter refreshing apparatus for the dry cleaning machine, comprising several joint packagings each between adjacent core pipes for connecting a plurality of waste filters in series in the apparatus so as to connect respective core pipes of the waste filters straightly from a hot air intaking side to an end of the serial filters, a reheating heater installed around the outer periphery of the pressure tank, a circulation duct connecting the hot air intaking side ad an outlet of hot air containing solvent gas, a cooling mans for recovering solvent, and a heating means placed in a downstream of the cooling means, wherein hot air is supplied from the hot air intaking port of the pressure tank to serially-connected core pipes and outer peripheries of respective waster filters in order that the remaining solvent within the waste filters is isolated by the hot air current from the center of the waste filters to the periphery thereof and is conveyed to the circulation duct outside of the pressure tank to evaporate remaining solvent in the waster or dirty filters and recover it from the dirty filters thereby cleaning the waste filters themselves.

* * * * *